US011201409B2

(12) United States Patent
Sone

(10) Patent No.: US 11,201,409 B2
(45) Date of Patent: Dec. 14, 2021

(54) PATCH ANTENNA AND ANTENNA DEVICE

(71) Applicant: YOKOWO CO., LTD., Tokyo (JP)

(72) Inventor: Takayuki Sone, Tomioka (JP)

(73) Assignee: YOKOW CO., LTD., Tokyo (JP)

( * ) Notice: Subject to any disclaimer, the term of this patent is extended or adjusted under 35 U.S.C. 154(b) by 0 days.

(21) Appl. No.: 16/627,362

(22) PCT Filed: Sep. 21, 2018

(86) PCT No.: PCT/JP2018/035167
§ 371 (c)(1),
(2) Date: Dec. 30, 2019

(87) PCT Pub. No.: WO2019/065531
PCT Pub. Date: Apr. 4, 2019

(65) Prior Publication Data

US 2020/0127381 A1 Apr. 23, 2020

(30) Foreign Application Priority Data

Sep. 28, 2017 (JP) ..... JP2017-188509

(51) Int. Cl.
*H01Q 9/04* (2006.01)
*H01Q 1/32* (2006.01)

(52) U.S. Cl.
CPC ..... *H01Q 9/0471* (2013.01); *H01Q 1/32* (2013.01)

(58) Field of Classification Search
CPC ..... H01Q 1/32; H01Q 1/48; H01Q 1/3275; H01Q 9/0471; H01Q 9/0414
USPC ..... 343/713
See application file for complete search history.

(56) References Cited

U.S. PATENT DOCUMENTS

2003/0216793 A1* 11/2003 Karlsson ..... A61N 1/37229 607/60
2007/0241978 A1* 10/2007 Cheng ..... H01Q 9/0407 343/754
2007/0257843 A1* 11/2007 Gooshchin ..... H01Q 5/25 343/700 MS
2012/0306721 A1* 12/2012 Okegawa ..... H01Q 9/0442 343/905

(Continued)

FOREIGN PATENT DOCUMENTS

EP 2 750 248 A1 7/2014
EP 3 032 641 A1 6/2016

(Continued)

OTHER PUBLICATIONS

Office Action dated Apr. 4, 2018 in Japanese Patent Application No. 2017-188509, 6 pages.

(Continued)

*Primary Examiner* — Lam T Mai
(74) *Attorney, Agent, or Firm* — Xsensus LLP

(57) ABSTRACT

A patch antenna includes a patch element and a ground conductor facing the patch element. The patch element is convex toward a side opposite to a side facing the ground conductor. Preferably, the patch element is convex while centering around at least one center line. Here, end portions on both sides of the patch element are positioned across the center line to face each other, and surfaces parallel to a direction toward the ground conductor from the respective end portions on the both sides at the shortest distance intersect or become a same surface.

11 Claims, 9 Drawing Sheets

(56) References Cited

U.S. PATENT DOCUMENTS

| | | | | |
|---|---|---|---|---|
| 2019/0131699 | A1* | 5/2019 | Shamblin | H01Q 9/0421 |
| 2020/0127381 | A1* | 4/2020 | Sone | H01Q 1/32 |

FOREIGN PATENT DOCUMENTS

| | | |
|---|---|---|
| JP | 03-080703 | 4/1991 |
| JP | 09-064636 | 3/1997 |
| JP | 2003-234617 | 8/2003 |
| JP | 2003-347838 | 12/2003 |
| JP | 2005-184077 | 7/2005 |
| JP | 2014-064085 | 4/2014 |

OTHER PUBLICATIONS

Office Action dated Jun. 27, 2018 in Japanese Patent Application No. 2017-188509, 6 pages.

Written Opinion of the International Searching Authority dated Nov. 27, 2018, in PCT/JP2018/035167, 13 pages.

Extended European Search Report dated May 3, 2021 in European Patent Application No. 18862711.1, 10 pages.

Hirokazu Kobayashi, "Radiation Pattern of Rectangular Patch Antenna with Curved Surface", 2016 URSI International Symposium on Electromagnetic Theory (EMTS), IEEE, Aug. 14, 2016, 4 pages, XP032968452.

Jian-Ming Jin, et al., "Calculation of Radiation Patterns of Microstrip Antennas on Cylindrical Bodies of Arbitrary Cross Section", IEEE Transactions on Antennas and Propagation, vol. 45, No. 1, Jan. 1, 1997, 7 pages, XP011002872.

Ruenn-Bo Tsai, et al., "Analysis of Cylindrical Printed Slot and Slot-Coupled Microstrip Antennas", IEEE Antennas and Propagation Society International Symposium Digest. Newport Beach, Jun. 18-23, 1995. Held in Conjunction With the USNC/URSI National Radio Science Meeting, vol. 4, Jun. 18, 1995, pp. 1788-1791, XP000588867.

* cited by examiner

PATCH ANTENNA AND ANTENNA DEVICE

CROSS-REFERENCE TO RELATED APPLICATIONS

The present application is based on PCT filing PCT/JP2018/035167, filed Sep. 21, 2018, which claims priority to JP 2017-188509, filed Sep. 28, 2017, the entire contents of each are incorporated herein by reference.

TECHNICAL FIELD

The present invention relates to a patch antenna including a patch element having a curved surface or a bent surface shape, and an antenna device including said patch antenna.

BACKGROUND ART

In a conventional patch antenna, since a patch element as a radiation electrode is planar, a directivity in a direction perpendicular to the patch element is high, that is, a half-value angle (range of a directivity angle from a gain peak to −3 dB) is narrow.

CITATION LIST

Patent Literature

Patent Literature 1: JP-A-2003-347838

SUMMARY OF INVENTION

Technical Problem

As described above, the conventional patch antenna has the narrow half-value angle, in other words, a gain on a lateral side of a patch antenna in a direction parallel to the patch element is low. Therefore, the conventional patch antenna is not suitable for use in transmitting and receiving a radio wave in a wide angle range.

The present invention has been made in view of circumstances, and an object of the present invention to provide a patch antenna and an antenna device that can transmit and/or receive a radio wave in a wide angle range by forming a patch element into a curved surface or a bent surface to widen a half-power angle in directional characteristics.

Solution to Problem

An aspect of the present invention is a patch antenna. The patch antenna includes a patch element, and a ground conductor facing the patch element, in which the patch element is convex toward a side opposite to a side facing the ground conductor.

It is preferable that the patch element is convex while centering around at least one center line, end portions on both sides of the patch element are positioned across the center line to face each other, and surfaces parallel to a direction toward the ground conductor from the respective end portions on the both sides at the shortest distance intersect or become a same surface.

It is preferable that the patch element has a plate shape that is curved and bent at a central portion.

It is preferable that a power is fed at one end portion side of the patch element in a direction of the center line.

It is preferable that wave sources are positioned at both end portions of the patch element in the direction of the center line.

It is preferable that the patch element has an outer surface on a side opposite to a side facing the ground conductor, one end portion of the outer surface is directed to a first direction, and the other end portion is directed to a second direction opposite to the first direction.

It is preferable that the patch element has a ridge line.

It is preferable that a dielectric body is provided between the patch element and the ground conductor.

It is preferable that an inner conductor of a coaxial cable is connected to the patch element, and an outer conductor of the coaxial cable is connected to the ground conductor.

Another aspect of the present invention is an antenna device. The antenna device includes said patch antenna.

It is preferable that the patch antenna is supported by a vehicle body so as to be used for vertically polarized waves.

Any combinations of the above constituent elements, and expressions of the present invention that are converted in methods and systems are also effective as aspects of the present invention.

Advantageous Effects of Invention

According to the present invention, since the patch antenna includes the patch element having the curved surface or the bent surface shape, a half-value angle in directional characteristics can be widened, so that a radio wave can be transmitted and/or received in a wide angle range.

DESCRIPTION OF EMBODIMENTS

Figure 1:
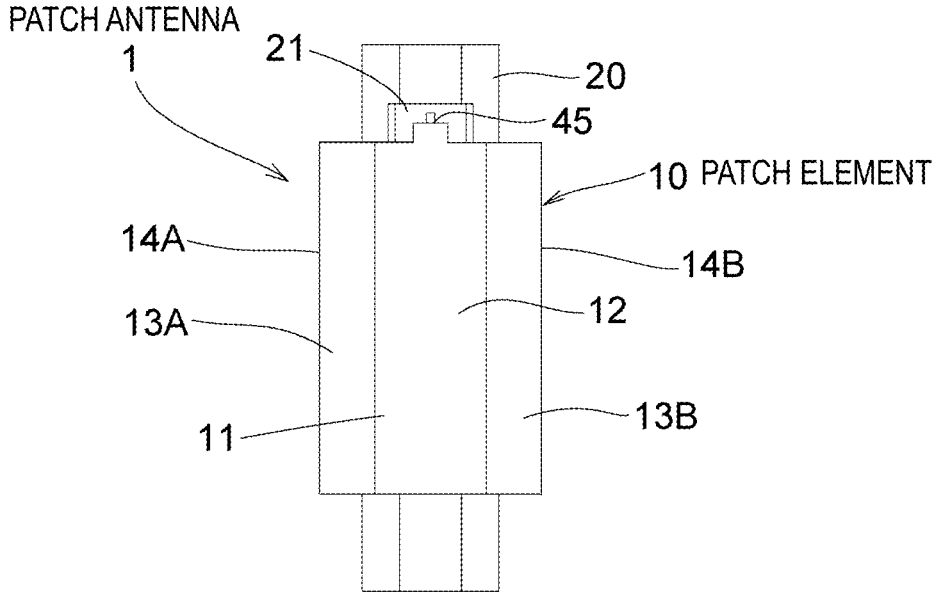
FIG. 1 is a front view showing a patch antenna portion in a patch antenna and an antenna device according to a first embodiment of the present invention.

Hereinafter, preferred embodiments of the present invention will be described in detail with reference to the drawings. The same or equivalent components, members, processes, or the like illustrated in the drawings are denoted by the same reference numerals, and a repetitive description thereof will be omitted. In addition, the embodiments are not intended to limit the invention but are examples, and all the features and combinations thereof described in the embodiments are not necessarily essential to the invention.

Figure 2:
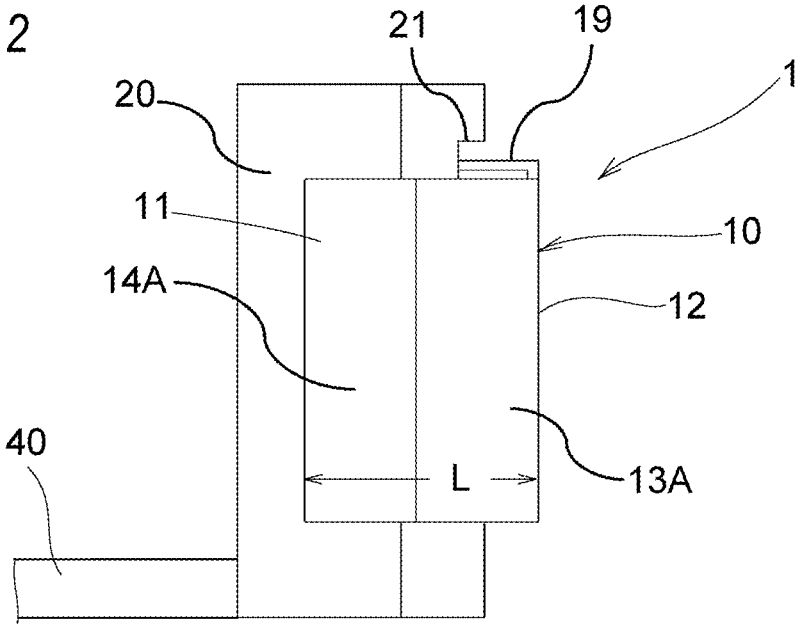
FIG. 2 is a side view showing the patch antenna portion in the patch antenna and the antenna device according to the first embodiment of the present invention.
Figure 3:
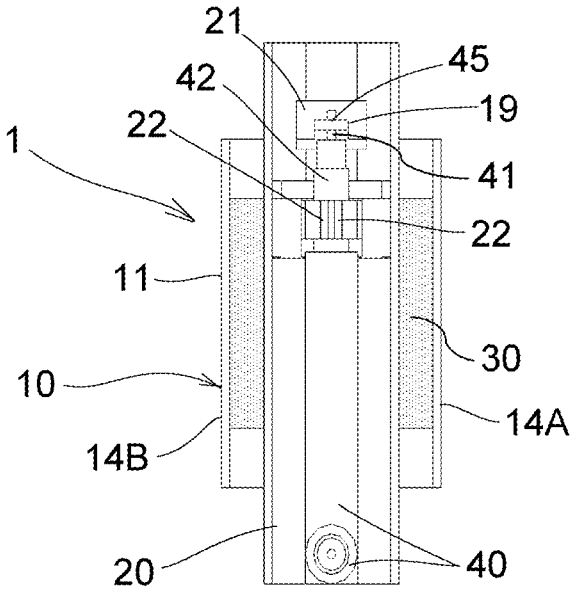
FIG. 3 is a back view showing the patch antenna portion in the patch antenna and the antenna device according to the first embodiment of the present invention.
Figure 4:
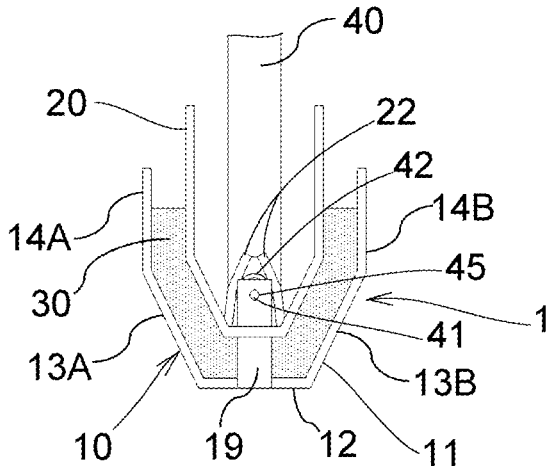
FIG. 4 is a plan view showing the patch antenna portion in the patch antenna and the antenna device according to the first embodiment of the present invention.
Figure 5:
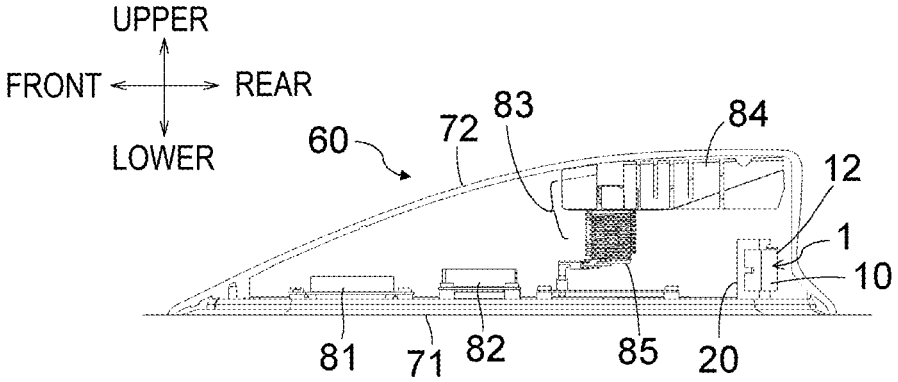
FIG. 5 is a side sectional view showing an overall configuration of an antenna device for a vehicle including the patch antenna.

FIGS. 1 to 4 show a first embodiment of a patch antenna and an antenna device according to the present invention, FIG. 1 is a front view of a patch antenna portion, FIG. 2 is a side view showing the patch antenna portion, FIG. 3 is a back view showing the patch antenna portion, and FIG. 4 is a plan view showing the patch antenna portion. FIG. 5 is a side sectional view showing an overall configuration of the antenna device including the patch antenna.

First, a patch antenna 1 will be described with reference to FIGS. 1 to 4. Here, the patch antenna 1 is used for, for example, V2X (Vehicle to Everything: Vehicle and Vehicle, Road and Vehicle) communication. The patch antenna 1 is arranged vertically (that is, a vertical direction) with respect to a horizontal plane (a plane perpendicular to a direction of gravity) and is used for vertically polarized waves. The patch antenna 1 includes a patch element 10 being a radiation electrode, a ground conductor plate 20 facing the patch element 10, a dielectric body 30 interposed between the patch element 10 and the ground conductor plate 20, and a coaxial cable 40 as a power feeding line.

The patch element 10 is formed by bending a planar metal plate conductor into a bent surface shape (here, including a shape by bending a plane such that one or a plurality of ridge lines are formed) convex toward a side opposite to a side facing the ground conductor plate 20. The patch element 10 is convex while centering around at least one center line. Further, end portions on both sides of the patch element 10 are positioned across the center line, and surfaces parallel to a direction toward the ground conductor plate 20 from the end portions on the both sides at the shortest distance intersect or become the same surface. That is, the patch element 10 has a plate shape that is curved and bent at a central portion. Specifically, the patch element 10 is formed by bending the sheet metal conductor so as to have four ridge lines, and an outer surface 11 (a surface on an opposite side to a surface on the side facing the ground conductor plate 20) that does not face the ground conductor plate 20 has five rectangular planes partitioned by the four ridge lines in an upper-lower direction (parallel to the center line). That is, the outer surface 11 of the patch element 10 has a front surface portion 12, first side surface portions 13A, 13B that are bent from the front surface portion 12, and second side surface portions 14A, 14B that are bent from the first side surface portions 13A, 13B so as to be perpendicular to the front surface portion 12. At this time, the center line is parallel to two ridge lines sandwiching the front surface portion 12, and is positioned in the middle of the two ridge lines. When the patch element 10 is viewed from the front, the first side surface portion 13A and the second side surface portion 14A are directed leftward, and the first side surface portion 13B and the second side surface portion 14B are directed rightward. As a result, the patch element 10 has a predetermined length L in a front-rear direction (a direction orthogonal to the front surface portion) (FIG. 2).

The ground conductor plate 20 is formed by bending a planar metal plate conductor so as to have four ridge lines similarly to the patch element 10, and has portions respectively parallel to the front surface portion 12, the first side surface portions 13A, 13B, and the second side surface portions 14A, 14B. Further, in the ground conductor plate 20, a hole 21 is provided in a region including an position facing a center of an upper side of the front surface portion 12 of the patch element 10 and a periphery thereof.

The dielectric body 30 is, for example, an ABS resin and is sandwiched between the patch element 10 and the ground conductor plate 20. The dielectric body 30 is molded in advance in accordance with a bent shape of the patch element 10. The patch element 10 and the ground conductor plate 20 are integrated by the dielectric body 30 interposed therebetween, and the patch element 10 is held by the ground conductor plate 20 via the dielectric body 30.

A power feeding conductor 19, that is a thin sheet strip-shaped conductor (may be pin-shaped), penetrates the hole 21 in a non-contact manner and connects an inner conductor 41 of the coaxial cable 40 and the patch element 10. For example, the power feeding conductor 19 may be formed by bending a strip-shaped conductor portion integral with the patch element 10. An outer conductor 42 of the coaxial cable 40 is sandwiched by a pair of clamping pieces 22 provided on the ground conductor plate 20, and is connected to the ground conductor plate 20.

In the patch antenna 1, the power feeding conductor 19 is connected to the patch element 10 at an end surface of the patch element 10 for impedance matching with characteristic impedance of the coaxial cable 40 (a power feeding point 45 is positioned at a height of the end surface of the patch element 10). The power feeding conductor 19 may be connected to the patch element 10 at a position (for example, a position below the end surface) other than the end surface of the patch element 10 as long as the impedance matching with the characteristic impedance of the coaxial cable 40 can be performed. In addition, in the patch antenna 1, the power feeding conductor 19 is connected to the patch element 10 at a central position of the patch element 10 when the patch element 10 is viewed in a horizontal plane (the power feeding point 45 is positioned at the central position of the patch element 10 when the patch element 10 is viewed in the horizontal plane). This is because, when the power geed point 45 is shifted from the central position of the patch element 10 with viewing the patch element 10 in the horizontal plane, distances from the power feeding point 45 to left and right ends of the patch element 10 are different on the left and right, and unnecessary resonance may occur in the patch antenna 1. As shown in FIG. 1, in a case where the patch element 10 is power-fed at one end portion side of the patch element 10 in a direction of the center line, wave sources are positioned at both end portions of the patch element 10 in the direction of the center line. That is, in the patch antenna 1 of FIG. 1, since the power is fed from an upper side of the patch element 10 in the upper-lower direction, the wave sources are generated at an upper end portion and a lower end portion of the patch element 10 in the upper-lower direction. Even when the power is fed from a lower side of the patch element 10 in the upper-lower direction, the wave sources are generated at the upper end portion and the lower end portion of the patch element 10 in the upper-lower direction.

The patch antenna 1 does not have a short-circuit conductor such as an inverted F-shaped antenna.

FIG. 5 is an antenna device 60 for a vehicle including the patch antenna 1. An SXM antenna 81 for satellite digital radio broadcast reception, GNSS (Global Navigation Satellite System) antenna 82, an AM/FM broadcast receiving antenna 83, and the patch antenna 1 for V2X communication are mounted on an antenna base 71 mounted on a vehicle body roof from the front in this order, and a radio wave transmitting antenna case 72 is placed on the antenna base 71 so as to cover these antennas. In FIG. 5, an upper-lower direction, and a front-rear direction of the antenna device 60 for a vehicle are defined. Upper, lower, left and right directions in a paper surface respectively indicate upper, lower, front and rear directions of the antenna device 60.

The SXM antenna 81 and the GNSS antenna 82 are patch antennas configuring a planar antenna and have a directivity upward. The AM/FM broadcast receiving antenna 83 has a series connection between a capacitance loading element 84 being a conductive plate and a coil 85. The capacitance loading element 84 has, for example, a meandering shape. In addition, the coil 85 may be disposed substantially at a center of the antenna device 60 for a vehicle or may be offset therefrom. The patch antenna 1 for the V2X communication is arranged so as to erect vertically on the antenna base 71 by fixing the ground conductor plate 20 to the antenna base 71, and is arranged such that the front surface portion 12 of the patch element 10 is directed rearward. In addition, in a state in which the antenna device 60 for a vehicle is attached on the vehicle body roof, the patch element 10 of the patch antenna 1 forms a substantially vertical plane and is supported by the vehicle body, and the patch antenna 1 is used for the vertically polarized waves.

Figure 6:
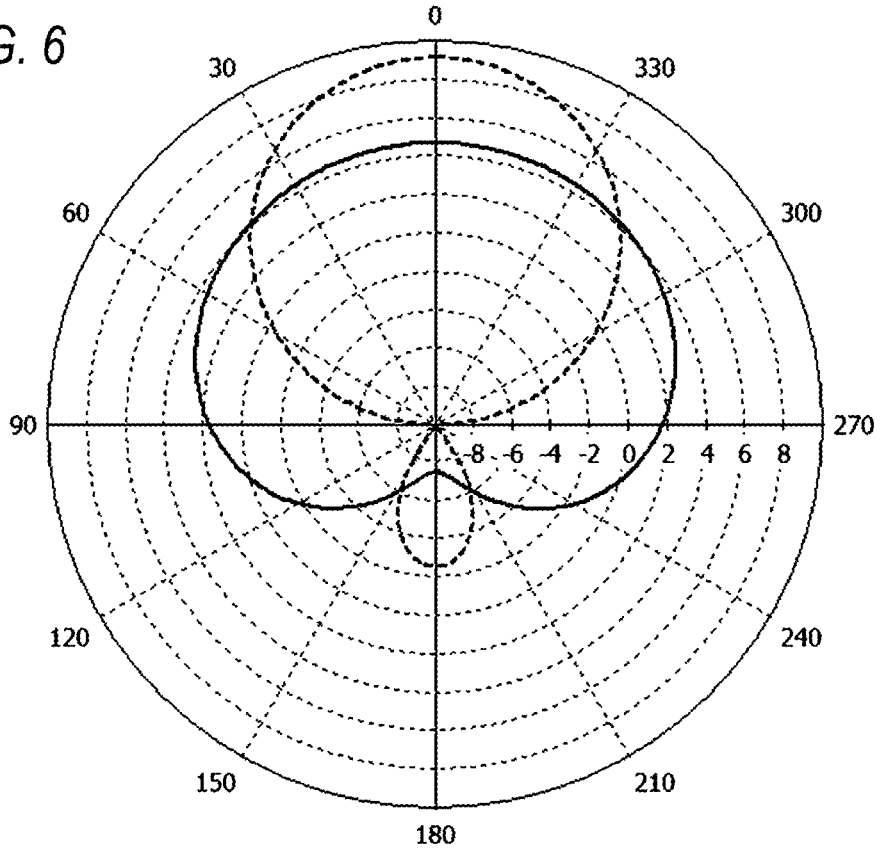
FIG. 6 is a directional characteristic diagram obtained by simulation showing a horizontal plane gain of the patch antenna according to the first embodiment in comparison with a horizontal plane gain according to a comparative example (FIG. 9).

FIG. 6 is a directional characteristic diagram obtained by simulation showing a horizontal plane gain (solid line) of the patch antenna 1 according to the first embodiment in comparison with a horizontal plane gain (dotted line) according to a comparative example (described later in FIG. 9), in which frequency: 5887.5 MHz, main lobe gain: 4.62 dB, main lobe azimuth: 0°, and half-value angle (angle range from a gain peak to −3 dB): 181.4°. In the case of FIG. 5, an azimuth angle 0° in FIG. 6 is backward, and the half-value angle of the patch antenna 1 according to the first embodiment can be ensured to be 180° or more as compared with the narrow half-value angle in the comparative example of FIG. 9. The reason why the half-value angle is increased is that the patch element 10 is bent to form a curved surface convex toward the outer surface thereof, and the patch element 10 has the predetermined length L in the front-rear direction. FIG. 6 shows a simulation result in a case where the patch antenna 1 is present alone, but it is considered that an influence on horizontal plane directional characteristics can be ignored even if the capacitance loading element 84 extends above the patch antenna 1 as shown in FIG. 5.

Figure 7:
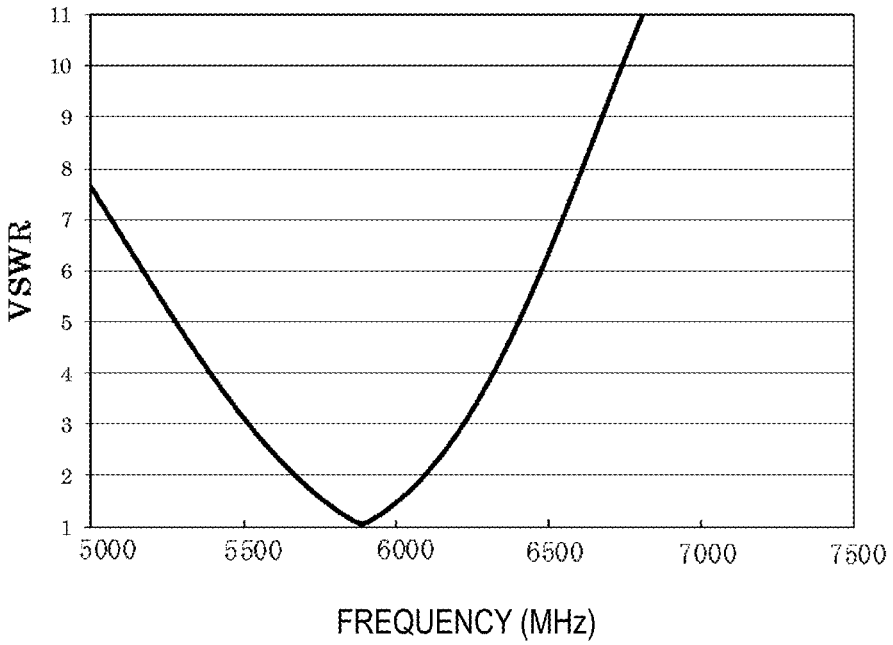
FIG. 7 is a VSWR characteristic diagram obtained by simulation of the patch antenna.

FIG. 7 is a VSWR characteristic diagram obtained by simulation of the patch antenna 1. As shown in FIG. 7, the VSWR is not low other than the frequency of 5.9 GHz, and unnecessary resonance does not occur in the patch antenna 1 in the vicinity of 5.9 GHz.

According to the present embodiment, the following effects can be achieved.

(1) In the patch antenna 1 including the patch element 10 and the ground conductor plate 20 facing the patch element 10, the patch element 10 has the bent surface shape formed by bending the metal plate conductor so as to have the four ridge lines, and is convex toward the side opposite to the side facing the ground conductor plate 20, so that the half-value angle can be made wider than a general patch antenna using the planar patch element.

(2) The patch element 10 has the outer surface 11 on the opposite side to the side facing the ground conductor plate 20, and has a shape in which the first side surface portion 13A and the second side surface portion 14A respectively bent with respect to the front surface portion 12 being a central portion of the outer surface 11 are directed leftward, and the first side surface portion 13B and the second side surface portion 14B are directed rightward, so that the half-value angle can be widened to 180° or more.

(3) By setting the first side surface portion 13A and the second side surface portion 14A directed leftward and the first side surface portion 13B and the second side surface portion 14B directed rightward to an appropriate length, the occurrence of the unnecessary resonance (resonance by a second mode) can be suppressed while maintaining the half-value angle at 180° or more. This point will be described later.

(4) The outer surface 11 of the patch element 10 is a polygonal surface on which the first side surface portion 13A, 13B, and the second side surface portion 14A, 14B are formed so as to have the ridge lines with respect to the front surface portion 12, and has a structure suitable for connecting the coaxial cable 40. That is, by ensuring an enough width of the front surface portion 12, a connection work to the coaxial cable 40 can be easily performed.

The reason why the patch element of the patch antenna is a curved surface or a bent surface will be described below with reference to FIGS. 8 to 15.

a. Expansion of Half-Value Angle

Figure 8:
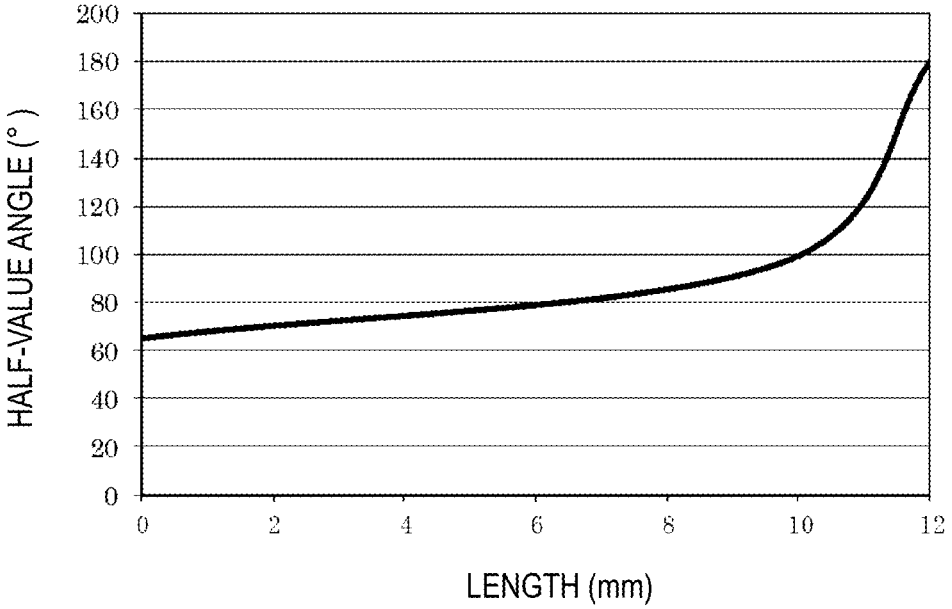
FIG. 8 is an explanatory diagram obtained by simulation showing a relationship between a length of the patch element in a front-rear direction and a half-value angle of the patch antenna.
Figure 9:
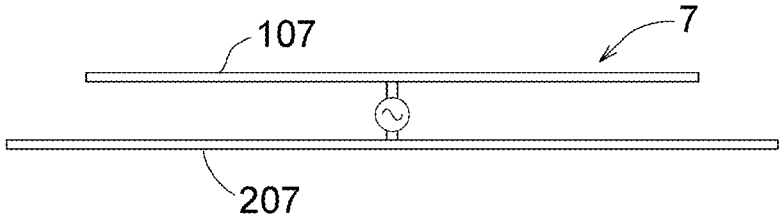
FIG. 9 is a horizontal sectional view of a patch antenna (normal patch antenna) of the comparative example when a length L of the patch element in the front-rear direction is 0 mm.
Figure 10:
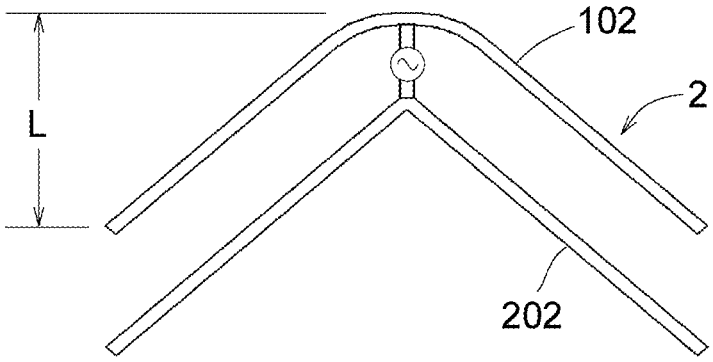
FIG. 10 is a horizontal sectional view of a patch antenna according to a second embodiment of the present invention when a length L of a patch element in a front-rear direction is 9.7 mm ($0.19\lambda_0$, where $\lambda_0$ indicates a wavelength in a free space).
Figure 11:
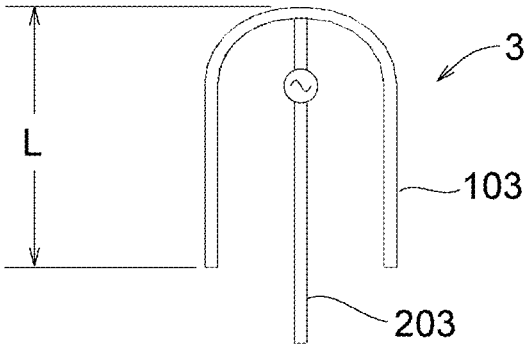
FIG. 11 is a horizontal sectional view of a patch antenna according to a third embodiment of the present invention when a length L of a patch element in a front-rear direction is 12 mm ($0.236\lambda_0$).

FIG. 8 is an explanatory diagram obtained by simulation showing a relationship between the length of the patch element in the front-rear direction and the half-value angle of the patch antenna. FIG. 9 is a horizontal sectional view of a patch antenna 7 (normal patch antenna) according to the comparative example when the length in a front-rear direction of the patch element used in the simulation of FIG. 8 is 0 mm, FIG. 10 is a horizontal sectional view of a patch antenna 2 according to a second embodiment of the present invention used in the simulation of FIG. 8 when a length L of the patch element in a front-rear direction is 9.7 mm, and FIG. 11 is a horizontal sectional view of a patch antenna 3 according to a third embodiment of the present invention used in the simulation of FIG. 8 when a length L of the patch element in a front-rear direction is 12 mm. In the simulation of FIG. 8, the half-value angle is obtained assuming that an operation frequency of the patch antenna of FIGS. 9 to 11 is 5887.5 MHz. In addition, in a case where $\lambda_0$ is a wavelength in a free space, the length L of the patch element in the front-rear direction of 9.7 mm corresponds to $0.19\lambda_0$, and the length L of the patch element in the front-rear direction of 12 mm corresponds to $0.236\lambda_0$.

In the patch antenna 7 according to the comparative example of FIG. 9, a patch element 107 and a ground conductor plate 207 are both flat plates and are arranged in parallel. A length L of the patch element 107 in a front-rear direction is 0 mm, and it can be seen from FIG. 8 that the half-value angle is the smallest.

In the patch antenna 2 according to the second embodiment shown in FIG. 10, a patch element 102 has a plate shape that is curved and bent at a central portion, and a ground conductor plate 202 is bent at a center portion and is arranged parallel to the patch element 102. A length L of the patch element 102 in a front-rear direction is 9.7 mm. Since the patch element 102 has a length component in the front-rear direction, as can be seen from FIG. 8, the half-value angle is wider than that in the comparative example of FIG. 9.

In the patch antenna 3 according to the third embodiment shown in FIG. 11, a patch element 103 has a plate shape that is curved and bent in a substantially semicircular arc shape at a central portion, and one end portion of an outer surface of the patch element 103 is directed leftward and the other end portion thereof is directed rightward. A length L of the patch element 103 in a front-rear direction is 12 mm. A ground conductor plate 203 is a flat plate and is arranged parallel to a main part of the patch element 103. In this case, as shown in FIG. 8, the half-value angle is further widened to 180°. The first embodiment described above has a structure corresponding to a case that the length L in the front-rear direction of the patch element shown in the third embodiment is 12 mm. In the simulation of FIG. 8, the lengths (creepage distance) in a horizontal cross section of the patch element shown in FIGS. 9 to 11 are all equal. In addition, the simulation shown in FIG. 8 is performed assuming that there is no coaxial cable in FIGS. 9 to 11.

As shown in FIG. 8, when the length L of the patch antenna in the front-rear direction is increased by making patch element curved, the half-value angle increases. As shown in the patch antenna 3 in FIG. 11, when the one end portion of the patch element 103 is directed leftward and the other end portion thereof is directed rightward, the half-value angle becomes 180°. That is, in order to increase the half-value angle, it is effective that the length L in the front-rear direction is increased by making the patch element curved, that is, the patch element is directed to not only the front (directed rearward of a vehicle in an arrangement of the antenna device 60 in FIG. 5) but also the left and right, and the half-value angle of 180° can be realized by setting the length L of the patch element in the front-rear direction to an appropriate value.

Further, the patch element may be directed only to the front and left or only to the front and right (the horizontal cross section of the patch element has an L shape). Since the patch antenna has a high directivity in a direction perpendicular to the patch element, in this case, the half-value angle is larger than that of the planar patch element of the normal patch antenna. However, the half-value angle of the patch antenna is smaller than that of the patch antenna 1 according to the first embodiment and the patch antenna 3 according to the third embodiment in which the patch elements are directed not only to the front but also to the left and right.

b. Suppression of Unnecessary Resonance (Resonance by Second Mode)

In a case of the patch antenna designed for the V2X communication, a resonance mode of the patch antenna includes a dominant mode that resonates at the frequency of 5.9 GHz for the V2X communication and a second mode that resonates at a frequency other than the frequency of 5.9 GHz.

Figure 12:
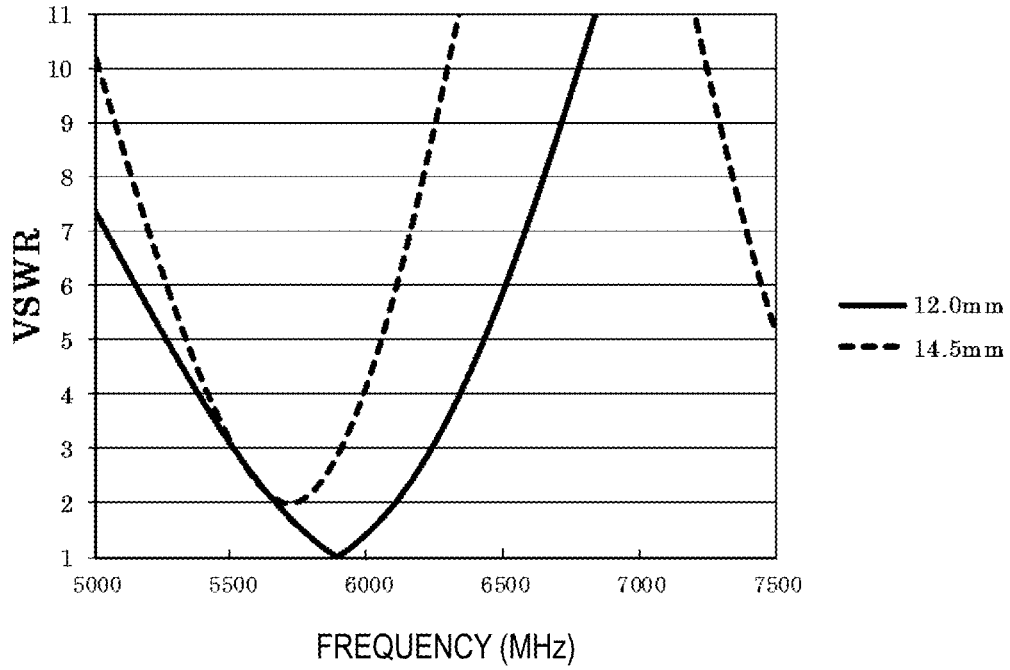
FIG. 12 is a VSWR characteristic diagram obtained by simulation of the third embodiment (length L of the patch element in the front-rear direction is 12 mm ($0.236\lambda_0$)) and a fourth embodiment (length L of a patch element in a front-rear direction is 14.5 mm ($0.285\lambda_0$)) to be described later.

FIG. 12 is a VSWR characteristic diagram obtained by simulation of the patch antenna when the lengths L of the patch element in the front-rear direction are 12 mm and 14.5 mm. In the simulation when the length L of the patch element in the front-rear direction in FIG. 12 is 12 mm, the patch antenna 3 according to the third embodiment shown in FIG. 11 was used. In addition, in the simulation when the length L of the patch element in the front-rear direction in FIG. 12 is 14.5 mm, a patch antenna 4 according to a fourth embodiment shown in FIG. 13 to be described later was used. In the case where $\lambda_0$ is the wavelength in the free space, the length L of the patch element in the front-rear direction of 12 mm corresponds to $0.236\lambda_0$, and the length L of the patch element in the front-rear direction of 14.5 mm corresponds to $0.285\lambda_0$.

Figure 13:
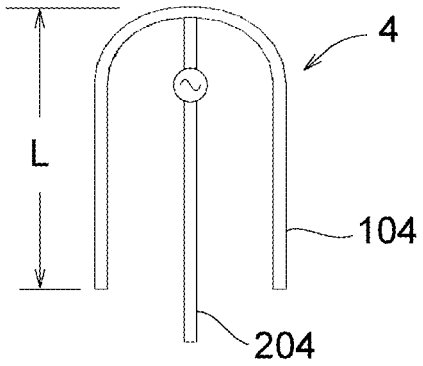
FIG. 13 is a horizontal sectional view of a patch antenna according to the fourth embodiment of the present invention when a length L of a patch element in a front-rear direction is 14.5 mm ($0.285\lambda_0$).

FIG. 13 is a horizontal sectional view of the patch antenna 4 according to the fourth embodiment used in the simulation when the length L of the patch element in the front-rear direction in FIG. 12 is 14.5 mm. In the patch antenna 4 according to the fourth embodiment shown in FIG. 13, a patch element 104 has a plate shape that is curved and bent in a substantially semicircular arc shape at a central portion, and one end portion of an outer surface of the patch element 104 is directed leftward and the other end portion thereof is directed rightward. A length L of the patch element 104 in a front-rear direction is 14.5 mm. A ground conductor plate 204 is a flat plate and is arranged parallel to a main part of the patch element 104.

In the fourth embodiment, a radius of curvature of the patch element 104 is the same as that of the patch element 103 in the third embodiment shown in FIG. 11. However, in order to make the length L of the patch element 104 in the front-rear direction larger than that of the patch element 103 in FIG. 11, the length of the patch antenna 4 in the horizontal cross section (in other words, a creepage distance of the patch element 104) is longer than the length of the patch antenna 3 (the creepage distance of the patch element 103) in FIG. 11. Therefore, as shown in FIG. 12, when the length L of the patch element in the front-rear direction is 12 mm (in the case of solid line), the VSWR is not low other than the frequency of 5.9 GHz, and the dominant mode is dominant, so that the unnecessary resonance (resonance by the second mode) does not occur in the vicinity of the dominant mode. On the other hand, when the length L of the patch element in the front-rear direction is 14.5 mm (in the case of dotted line), an influence of the second mode is strong, and characteristics of the dominant mode are deteriorated, so that the unnecessary resonance can be confirmed.

As can be seen from results of FIGS. 12 and 13, in order to suppress the occurrence of the unnecessary resonance, the length L of the patch element in the front-rear direction is shortened (not longer than necessary), that is, the length of the patch antenna in the horizontal cross section may be shortened (so as not to be longer than necessary).

c. Presence of Coaxial Cable

Figure 14:
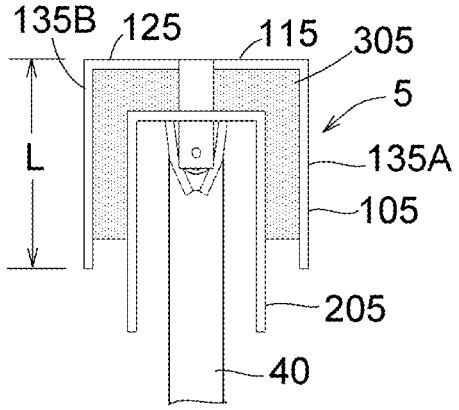
FIG. 14 is a plan view of a patch antenna according to a fifth embodiment of the present invention, which has a structure suitable for a coaxial cable, as viewed from above.

The simulation of FIG. 8 is performed assuming that there is no coaxial cable in the comparative example of FIG. 9, the second embodiment of FIG. 10, and the third embodiment of FIG. 11, but the patch antenna needs to be electrically connected to the coaxial cable for feeding. FIG. 14 is a plan view of a patch antenna 5 having a structure suitable for feeding by the coaxial cable 40 as viewed from above, according to a fifth embodiment. In this case, the patch antenna 5 includes a patch element 105, a ground conductor plate 205 facing the patch element 105, a dielectric body 305 interposed between the patch element 105 and the ground conductor plate 205, and the coaxial cable 40 as a power feeding line.

The patch element 105 according to the fifth embodiment has a bent surface shape formed by bending a planar metal plate conductor so as to have two ridge lines, and an outer surface 115 has three rectangular planes partitioned by the two ridge lines in the upper-lower direction. That is, the outer surface 115 of the patch element 105 has a front surface portion 125, and side surface portions 135A, 135B that are bent perpendicularly to the front surface portion 125, respectively. When the patch element 105 is viewed from the front, the side surface portion 135A is directed leftward and the side surface portion 135B is directed rightward. The ground conductor plate 205 is formed by bending a planar metal plate conductor so as to have two ridge lines similarly to the patch element 105, and has portions respectively parallel to the front surface portion 125 and the side surface portions 135A, 135B. A length L of the patch element 105 in a front-rear direction is set to the same length as that in the first embodiment. Other configurations are similar to those in the first embodiment.

Figure 15:
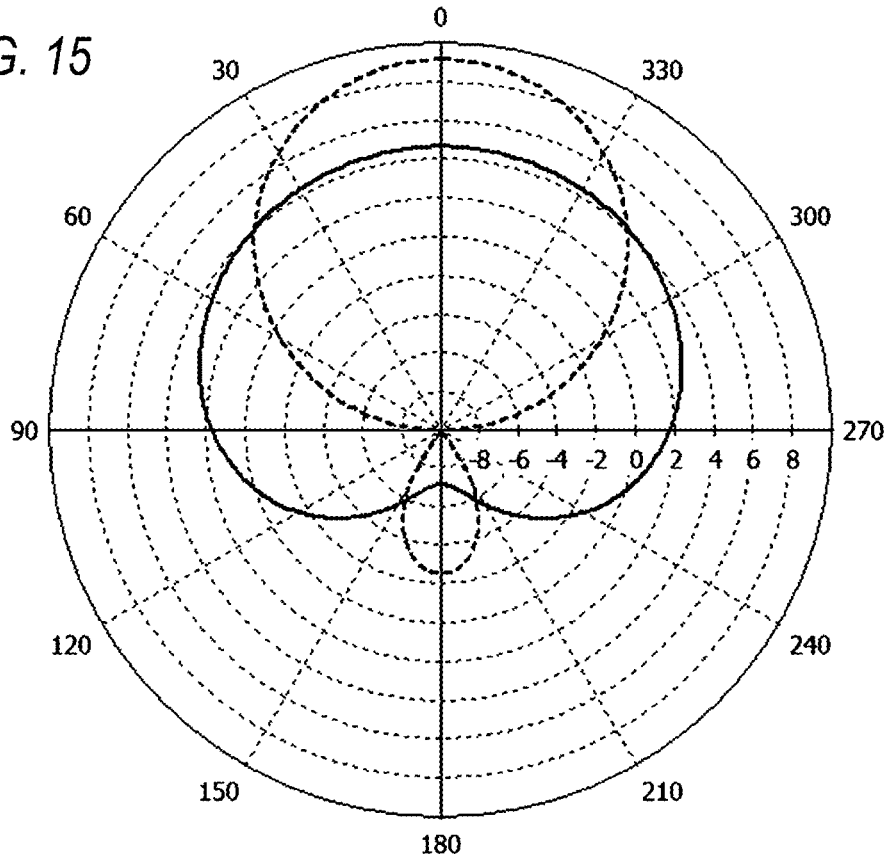
FIG. 15 is a directional characteristic diagram obtained by simulation showing a horizontal plane gain of the patch antenna according to the fifth embodiment in comparison with the horizontal plane gain according to the comparative example (FIG. 9).

FIG. 15 is a directional characteristic diagram obtained by simulation showing a horizontal plane gain (solid line) of the patch antenna 5 according to the fifth embodiment in comparison with the horizontal plane gain (dotted line) according to the comparative example (FIG. 9). At a frequency of 5887.5 MHz, the half-value angle (angle range from a gain peak to −3 dB) can be ensured to be 180° or more.

Figure 16:
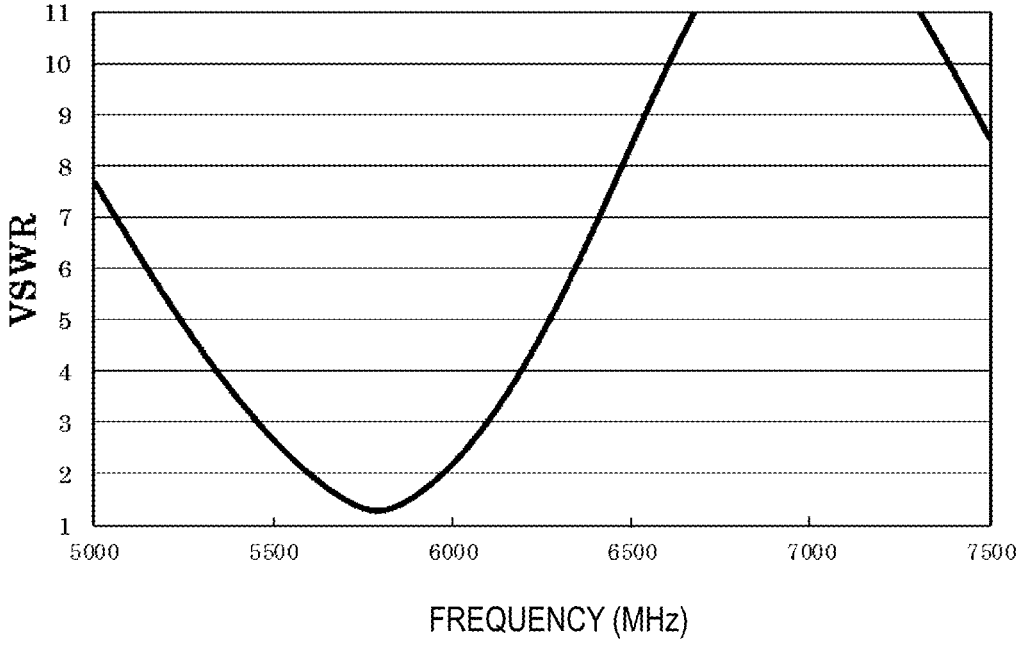
FIG. 16 is a VSWR characteristic diagram obtained by simulation of the patch antenna according to the fifth embodiment.

FIG. 16 is a VSWR characteristic diagram obtained by simulation of the patch antenna 5 adapted to the coaxial cable according to the fifth embodiment. In the patch antenna 5 according to the fifth embodiment of FIG. 14, since the patch element 105 has a curved surface shape having the two ridge lines, one end portion of the patch element 105 is directed leftward and the other end portion is directed rightward, so that the half-value angle is 180° or more. However, as shown in FIG. 16, the unnecessary resonance can be confirmed in the patch antenna 5 of FIG. 14. This is because a creepage distance of the patch element 105 is longer than the creepage distance of the patch element 10 according to the first embodiment when the length L of the patch element 105 in the front-rear direction is set to the same value as in the first embodiment.

That is, in order to shorten the length of the patch antenna in the horizontal cross section while maintaining that the patch element is directed not only to the front but also to the left and right and the half-value angle is 180°, the patch element 10 of the patch antenna 1 in the first embodiment is formed into a bent surface shape having the four ridge lines, and is provided with the first side surface portions 13A, 13B between the second side surface portions 14A, 14B orthogonal to the front surface portion 12 and the front surface portion 12 (close to a circular arc-shaped curved surface).

Figure 17:
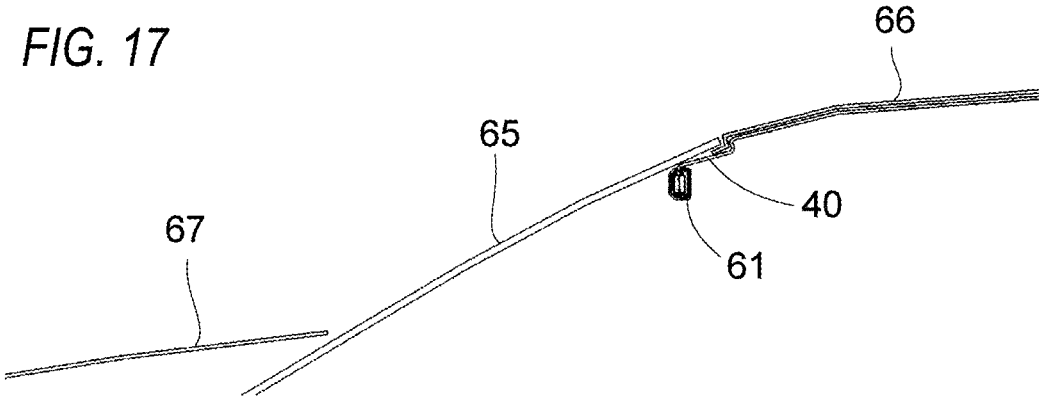
FIG. 17 is a side sectional view showing an antenna device according to a sixth embodiment of the present invention, which includes a patch antenna inside a windshield of a vehicle body.
Figure 18:
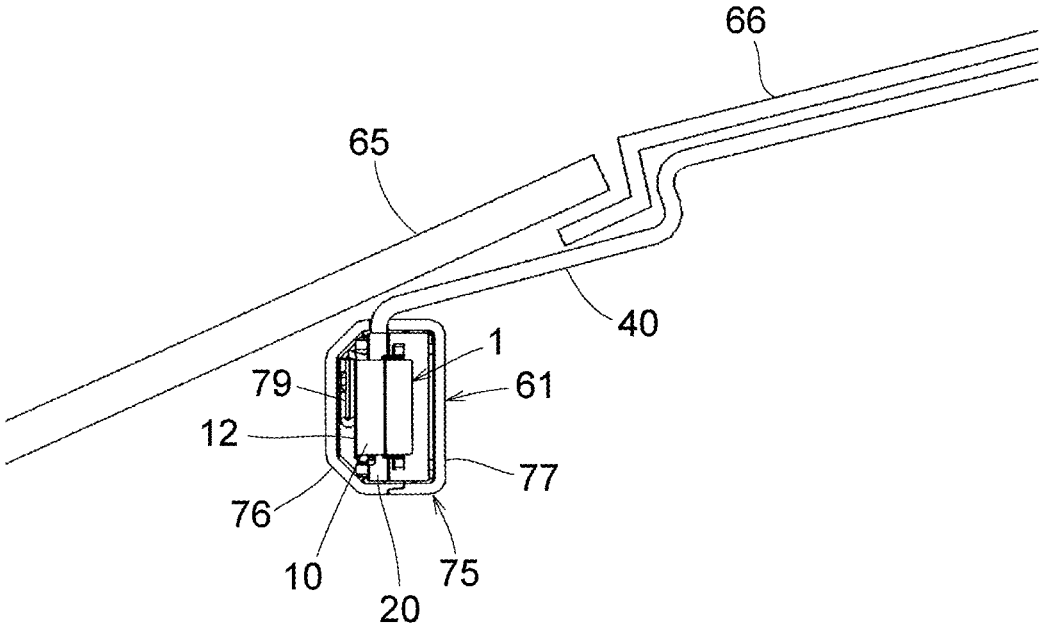
FIG. 18 is an enlarged sectional view of the same.

FIGS. 17 and 18 show the patch antenna and the antenna device according to a sixth embodiment of the present invention, in which an antenna device 61 is arranged inside a windshield 65 of the vehicle body having the windshield 65, a roof 66, a hood 67, or the like. In the antenna device 61, the patch antenna 1 as like in the first embodiment is accommodated in an antenna case 75 that is a combined structure of a front case portion (radio wave transmitting radome) 76 and a rear case portion 77. In this case, the patch antenna 1 is arranged such that the front surface portion 12 of the patch element 10 is directed to the front of the vehicle body, and the patch element 10 is held by the front case portion 76 via an attachment member 79, and the ground conductor plate 20 is held parallel to the patch element 10 at a predetermined interval (the ground conductor plate 20 may not be attached to the antenna case 75). Further, in this case, the patch element 10 of the patch antenna 1 forms a substantially vertical plane and is supported by the vehicle body, and the patch antenna 1 is used for the vertically polarized waves. The coaxial cable 40 that feeds the power to the patch antenna 1 is drawn out from the antenna case 75 along the inside of the windshield 65 and the roof 66.

In the sixth embodiment, the half-value angle of 180° or more including the front of the vehicle body can be ensured. Other operations and effects are similar to those of the first embodiment described above.

Although the present invention has been described above by taking the embodiments as an example, it will be understood by those skilled in the art that various modifications can be made to each component and each processing process of the embodiments within the scope of the appended claims. Hereinafter, a modification will be described.

In each embodiment, a space by omitting the dielectric body may be used as long as the patch element and the ground conductor plate can be held at the predetermined interval.

In addition, as long as the outer surface of the patch element is a curved surface shape convex toward the outside, the number of ridge lines may be any number, and the outer surface of the patch element may be a combination of a curved surface having no ridge line and a flat surface.

In the embodiments described above, the patch antenna 1 has been described as being used for, for example, the V2X communication. Here, the patch antenna 1 performs the V2X communication based on DSRC (Dedicated Short Range Communications) under IEEE 802.11p standard or based on C-V2X (Cellular-V2X) standard. In addition, the case where the patch antenna 1 resonates at the frequency of 5.9 GHz for the V2X communication has been described, but the embodiment is not limited thereto. For example, the patch antenna 1 may operate at another frequency to perform the V2X communication.

REFERENCE SIGNS LIST

1, 2, 3, 4, 5, 7 patch antenna
10, 102, 103, 104, 105, 107 patch element
12, 125 front surface portion
13A, 13B, 14A, 14B, 135A, 135B side surface portion
19 power feeding conductor
20, 202, 203, 204, 205, 207 ground conductor plate
21 hole
30, 305 dielectric body
40 coaxial cable
45 power feeding point

60, 61 antenna device
71 antenna base
72, 75 antenna case

The invention claimed is:

1. A patch antenna comprising:
a patch element; and
a ground conductor facing the patch element, wherein
the patch element is convex toward a side opposite to a side facing the ground conductor.

2. The patch antenna according to claim 1, wherein
the patch element is convex while centering around at least one center line,
end portions on both sides of the patch element are positioned across the center line to face each other, and
surfaces parallel to a direction toward the ground conductor from respective end portions on the both sides at the shortest distance intersect or become a same surface.

3. The patch antenna according to claim 1, wherein
the patch element has a plate shape that is curved and bent at a central portion.

4. The patch antenna according to claim 1, wherein
the patch element is fed a power at one end portion side of the patch element in a direction of a center line.

5. The patch antenna according to claim 1, wherein
the patch element is provided with wave sources positioned at both end portions of the patch element in the direction of a center line.

6. The patch antenna according to claim 1, wherein
the patch element has a ridge line.

7. The patch antenna according to claim 1, further comprising:
a dielectric body provided between the patch element and the ground conductor.

8. The patch antenna according to claim 1, wherein
the patch element is connected with an inner conductor of a coaxial cable, and the ground conductor is connected with an outer conductor of the coaxial cable.

9. An antenna device including the patch antenna according to claim 1.

10. The antenna device according to claim 9, wherein
the patch antenna is supported by a vehicle body so as to be used for vertically polarized waves.

11. The patch antenna according to claim 1, wherein
the patch element has an outer surface on a side opposite to a side facing the ground conductor,
one end portion of the outer surface is directed to a first direction, and
another end portion of the outer surface is directed to a second direction opposite to the first direction.

* * * * *